US007958883B2

(12) United States Patent
Tecirlioglu

(10) Patent No.: US 7,958,883 B2
(45) Date of Patent: Jun. 14, 2011

(54) COOKING DEVICE

(75) Inventor: Ahmet Taner Tecirlioglu, Istanbul (TR)

(73) Assignee: Arcelik A.S., Istanbul (TR)

( * ) Notice: Subject to any disclaimer, the term of this patent is extended or adjusted under 35 U.S.C. 154(b) by 0 days.

(21) Appl. No.: 12/159,344

(22) PCT Filed: Dec. 21, 2006

(86) PCT No.: PCT/EP2006/070086
§ 371 (c)(1),
(2), (4) Date: Jun. 26, 2008

(87) PCT Pub. No.: WO2007/077150
PCT Pub. Date: Jul. 12, 2007

(65) Prior Publication Data

US 2008/0308089 A1 Dec. 18, 2008

(30) Foreign Application Priority Data

Dec. 30, 2005 (TR) ..... A 2005 05412

(51) Int. Cl.
*F24C 3/10* (2006.01)

(52) U.S. Cl. ..... 126/52; 126/39 E; 126/35; 126/218; 126/214 A; 219/665

(58) Field of Classification Search ..... 126/39 E, 126/52, 35, 218, 214 R, 214 A
See application file for complete search history.

(56) References Cited

U.S. PATENT DOCUMENTS 5,809,990 A * 9/1998 Jones et al. ..... 126/39 N
6,173,708 B1 * 1/2001 Arntz et al. ..... 126/39 R

FOREIGN PATENT DOCUMENTS

DE 42 18 278 A1 12/1993
FR 2 628 186 A1 9/1989
GB 113 260 A 7/1918
GB 891 294 A 3/1962
GB 2 230 085 A 10/1990

* cited by examiner

*Primary Examiner* — Kenneth B Rinehart
*Assistant Examiner* — Hassan Brown
(74) *Attorney, Agent, or Firm* — Venable, Campillo, Logan & Meaney, P.C.

(57) ABSTRACT

The present invention relates to a cooking device (1) comprising a burner group (3), provided to be easily emplaced into the housing (15) without any problems after being detached and taken apart for maintenance, providing complete burning thereby preventing the formation of poisonous gases.

2 Claims, 2 Drawing Sheets

COOKING DEVICE

Figure 1:
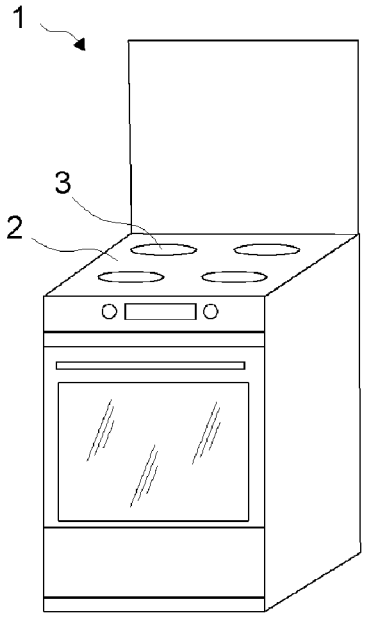

The present invention relates to cooking devices that comprise a burner group.

Conventional cooking device embodiments having a burner group comprise at least one burner plate that forms the body wherein the cookware for cooking or heating are seated and one or more burner groups situated on the openings on the burner plate that provide heating of the cookware. A burner group generally comprises a burner body that provides mixing of the gas and the ambient air for burning of the gas, a flame spreader for the discharge of the mixture to the cookware to be heated and the distribution of the discharged gas and/or a burner cap that aids the flame spreader.

In general implementations, the burner groups communicate with a gas source through a gas valve in order to realize heating. In the state-of-the-art Great Britain patent application no. GB2284648, the control of the gas valves is provided by a spindle that triggers a thermocouple and a flame failure device being magnetized by a magnetic valve to produce a current. This system which is widely utilized is one of the important methods devised for the safety of the user. The magnetic valve in this system is a component that can be magnetized by a milliampere magnitude current. When there is no current or under the determined current values, the valvelet of this magnetic valve is in the closed position and does not allow passage of the gas. The gas valve comprising a magnetic valve provides the magnetic valve to be opened mechanically by turning the spindle and hence allows the passage of gas. After the gas reaches the burner body and mixes with air there, it reaches the burner cap. Then, the gas mixed with air is kindled with an internal/external ignition. The flames formed around the burner group, heats the end of the (flame failure device) FFD, e.g. in 10 seconds and the FFD transfers the current of milliampere magnitude to the thermocouple. The thermocouple used here basically comprises two wires, one made of copper and the other of iron. The difference in the thermal conductivity of these two wires also results in a voltage difference and consequently a current is produced. Due to the flowing current, the valvelet inside the magnetic valve is magnetized and stays in the open position thus allowing passage of the gas. The flame burns as long as the gas flows. If the flame goes out due to any reason, the FFD end in the immediate vicinity starts to cool. E.g. in a 60 seconds cooling duration, the FFD end does not produce a current. In the end, the valvelet in the magnetic valve is set free since the magnetization is ended and the passage of gas stops.

The disadvantage of this system is that when the flame spreader is taken out for cleaning or maintenance purposes, the burner cap can't be properly put back in place due to incorrect positioning. Furthermore, when the flame spreader cannot be properly assembled in the housing of the burner body, the user may not readily notice this condition. The flame spreader cannot function as required since it is not centered and safety problems arise. Thus, even if the magnetic valvelet is opened, this leads to inefficient burning, sooty burning or the increase of carbon monoxide in the environment.

The German Patent no. DE4218278 is about a safety mechanism that allows the gas valve to open with a safety switch depending on the presence of an object. This mechanism is comprised of a vertically positioned pin near the burner and a mechanical switch connected to this pin. When an object is placed on the burner, it activates the switch by pressing on the pin and the gas valve is opened by the cooker control system.

In the European patent application no. EP0745811, a system is described that detects whether there is a moving weight on the cooker and controls the flow of gas accordingly. This system is composed of a pin positioned vertically in the vicinity of the burner, a ball on the pin head and a mechanical switch under the pin. When a cookware is placed on the burner, the pin moves downward releasing the mechanical switch and this switch sends a signal to the valve it is connected for allowing the gas to flow.

In the German Patent no. DE10357761, a cooking device is explained wherein the gas valve is controlled to be opened or closed by the weight of the cookware emplaced thereon. The shape of the flame spreader is changed by increasing the height in order to detect the presence of a cookware and the gaps of the gas outlets are situated under the flame spreader. The flame spreader is connected to the burner body by a spring mechanism such that it moves when the cookware is placed. This movement provides the gas valve to open by a mechanical connection.

The object of the present invention is the realization of a cooking device comprising a burner group having a flame spreader that is provided to be positioned accurately.

The cooking device realized in order to fulfill the objectives of the present invention is explicated in the first claim, other features are explicated in dependent claims.

In the embodiment of the present invention, when the flame spreader is assembled in the burner body, opening of the gas valve is provided by triggering a safety mechanism comprising a spindle and a switch arranged in the housing wherein the flame spreader will be seated.

The cooking device realized in order to fulfill the objectives of the present invention is illustrated in the attached figures, where:

FIG. 1—is the perspective view of a cooking device.

Figure 2:
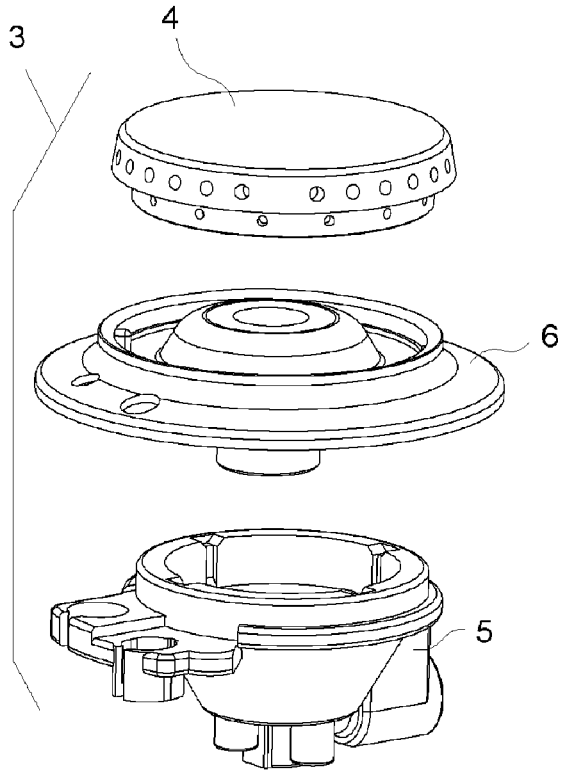

FIG. 2—is the exploded view of a flame spreader.

Figure 3:
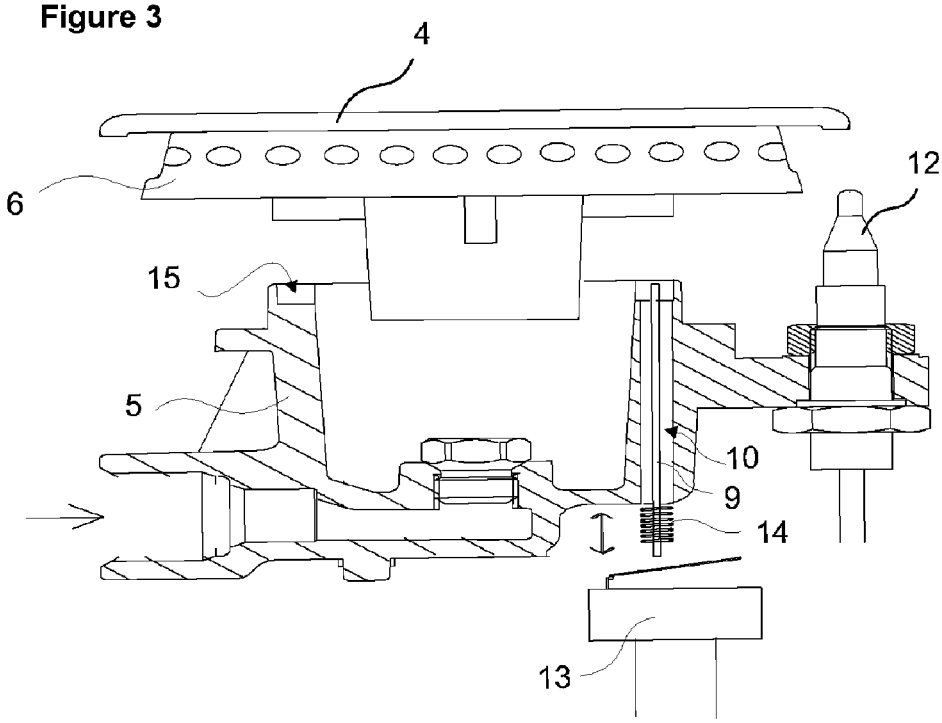

FIG. 3—is the schematic view of a burner group.

Figure 4:
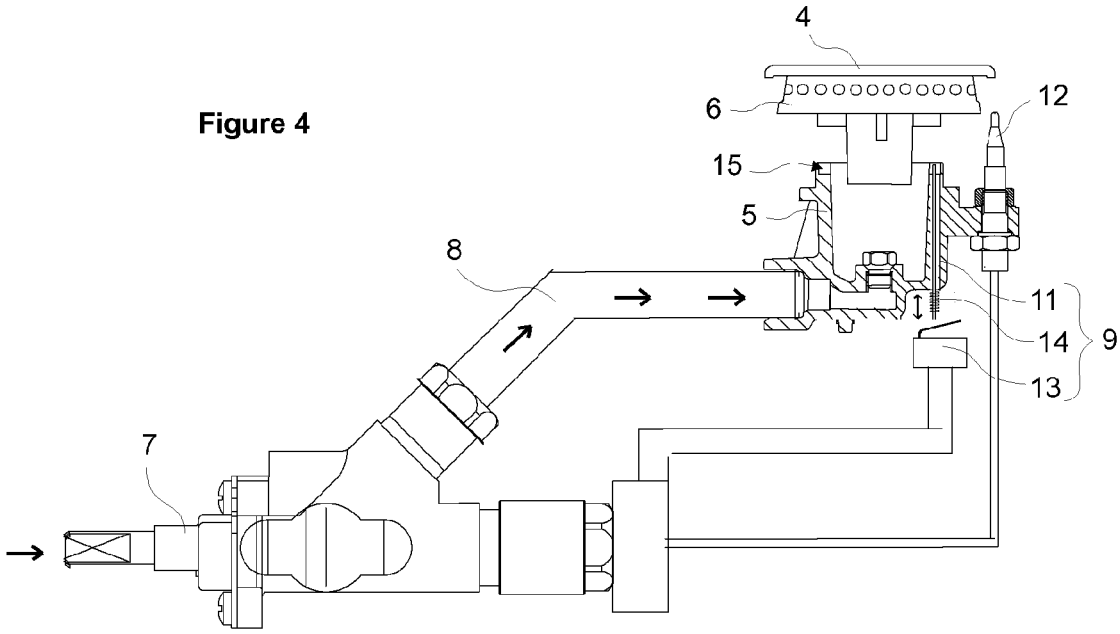

FIG. 4—is the assembled schematic view of a safety mechanism, a burner group and a gas valve.

Figure 5:
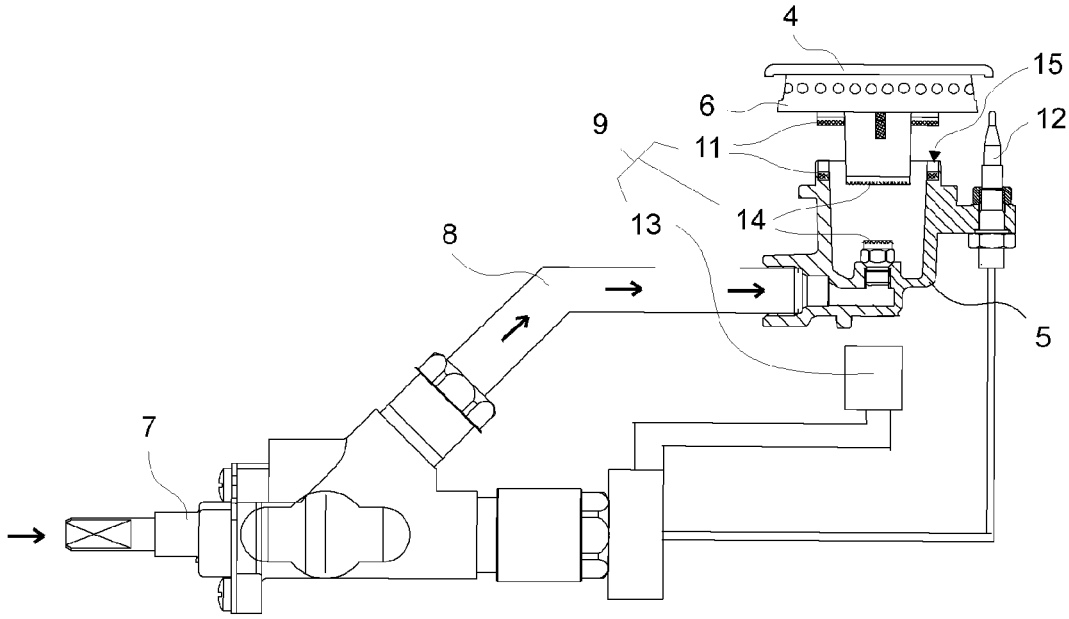

FIG. 5—is the assembled schematic view of a magnetic safety mechanism, a burner group and a gas valve.

Elements shown in figures are numbered as follows:

1. Cooking device
2. Burner plate
3. Burner group
4. Burner cap
5. Burner body
6. Flame spreader
7. Gas valve
8. Gas conduit
9. Safety mechanism
10. Channel
11. Actuator
12. Igniter
13. Switch
14. Pusher
15. Housing The cooking device (1) comprises a gas valve (7) for the opening closing control of the gas required for cooking, a gas conduit (8) connected to the gas valve (7), a burner plate (2) whereupon the cooking pots are emplaced, a burner group (3) on the burner plate (2) providing to heat the cooking pots and an igniter (12) for providing the initial ignition for forming of flames on the burner group (3).

The burner group (3) comprises a burner body (5) seated on the burner plate (2), a flame spreader (6) on the burner body (5), a burner cap (4), whose diameter from larger to smaller than the diameter of the flame spreader (6), on the flame spreader (6), a housing (15) on the burner body (5) wherein the flame spreader (6) is fitted, and a safety mechanism (9) that controls whether or not the flame spreader (6) is fitted in the housing (15).

The safety mechanism (9) comprises a switch (13) that provides opening closing of the gas valve (7), an actuator (11) that provides the flame spreader (6) to trigger the switch (13) when seated in the housing (15) accurately and a pusher (14) that allows the actuator (11) to resume its initial position after being triggered.

In the embodiment of the present invention, when the user desires to take apart the burner group (3) for cleaning purposes, the flame spreader (6) and the burner cap (4) are detached to be cleaned. When the cleaned flame spreader (6) and the burner cap (4) are to be mounted back in place, first the flame spreader (6) is placed on the burner body (5) and the flame spreader (6) is ensured to fit in the housing (15). When the flame spreader (6) is properly fitted in the housing (15), the actuator (11) triggers the switch (13) providing the opening of the gas valve (7). Since the actuator (11) has changed position, it is pushed by the pusher (14) in order to return to its initial position. Consequently, after the flame spreader (6) is assured of being seated in the housing (15), the gas valve (7) is allowed to be opened.

In an embodiment of the present invention, the safety mechanism (9) comprises a spindle shaped actuator (11) that contacts to trigger the switch (13), a channel (10) wherein the actuator (11) is housed, and a pusher (14) in the form of a spring that allows the actuator (11) to resume its initial position after triggering.

In this embodiment, the flame spreader (6) that is seated in the housing (15) properly, pushes the spring shaped actuator (11) and provides the actuator (11) to trigger the switch (13). When the switch (13) is triggered, the gas valve (7) is opened and allows passage of the gas. The pusher spring (14) provides the actuator (11) to resume its initial position after triggering the switch (13).

In another embodiment of the present invention, the safety mechanism (9) comprises two actuators (11), shaped as conductive plates, one in the housing (15), the other on the flame spreader (6), positioned oppositely such that they can contact, providing to trigger the switch (13) when they contact each other, and two magnet type pushers (14), one on the flame spreader (6), the other in the burner body (5), positioned opposite each other such that they can contact.

In this embodiment, when the flame spreader (6) is properly seated in the housing (15), the two conductive plate actuators (11) contact each other and the switch (13) is triggered. The switch (13), when triggered, opens the gas valve (7) and allows the passage of the gas. The two magnet-type pushers (14) that contact each other provide the actuator (11) to resume its initial position after triggering the switch (13).

By means of the embodiment of the present invention, the flame spreader (6) is provided to be properly seated in the housing (15), the passage of gas is prevented when it is not properly seated. Furthermore, the possibility of poisoning that may arise due to user errors is reduced by the safety mechanism (9) and also the possibility of sooty burning that may happen due to improper seating is eliminated.

The invention claimed is:

1. A cooking device comprising a gas valve for opening-closing control of a gas required for cooking a gas conduit connected to the gas valve, a burner plate, an igniter and a burner group having a burner body seated on the burner plate, a flame spreader on the burner body, a burner cap on the flame spreader, and a housing on the burner body into which the flame spreader is fitted, and a safety mechanism that controls whether or not the flame spreader is fitted in the housing, having a switch that provides opening closing of the gas valve, an actuator that provides the flame spreader to trigger the switch when fitted in the housing accurately and a pusher that allows the actuator to resume its initial position after triggering wherein the safety mechanism that comprises two actuators, shaped like conductive plates, one in the housing, the other on the flame spreader, positioned oppositely such that they can contact, providing to trigger the switch when they contact each other, and two magnet type pushers, one on the flame spreader, the other in the burner body, positioned opposite each other such that they can contact.

2. The cooking device as in claim 1, wherein the safety mechanism that comprises a spindle shaped actuator that actuates the switch by contacting a channel into which the actuator is housed, and a pusher in form of a spring that allows the actuator to resume its initial position after triggering.

* * * * *